US005791165A

United States Patent [19]

Von Harten et al.

[11] Patent Number: 5,791,165

[45] Date of Patent: Aug. 11, 1998

[54] SMALL TEXTILE-FINISHING INSTALLATION

[75] Inventors: Gunter Von Harten, Kaarst; Wolfgang Kurschatke, Krefeld, both of Germany

[73] Assignee: Eduard Kusters Maschinenfabrik GmbH & Co. KG, Krefeld, Germany

[21] Appl. No.: 793,065

[22] PCT Filed: Jul. 12, 1995

[86] PCT No.: PCT/DE95/00914

§ 371 Date: Apr. 24, 1997

§ 102(e) Date: Apr. 24, 1997

[87] PCT Pub. No.: WO96/05349

PCT Pub. Date: Feb. 22, 1996

[30] Foreign Application Priority Data

Aug. 16, 1994 [DE] Germany ..... 44 29 058.6

[51] Int. Cl.[6] ..... D06B 3/32

[52] U.S. Cl. ..... 68/5 C; 68/5 E; 68/9; 68/22 R; 68/22 B; 68/175; 68/180

[58] Field of Search ..... 68/5 C, 5 D, 5 E, 68/9, 22 R, 22 B, 175, 180

[56] References Cited

U.S. PATENT DOCUMENTS

| | | | |
|---|---|---|---|
| 2,204,839 | 6/1940 | Wedler | 68/180 X |
| 3,067,602 | 12/1962 | Brunt | 68/5 E |
| 4,466,258 | 8/1984 | Sando et al. | 68/5 E X |
| 5,431,031 | 7/1995 | Vinas | 68/5 D |

FOREIGN PATENT DOCUMENTS

| | | | |
|---|---|---|---|
| 1460390 | 2/1969 | Germany . | |
| 2638978 | 4/1977 | Germany . | |
| 2823530 | 12/1979 | Germany | 68/5 D |
| 3612999 | 11/1986 | Germany . | |
| 3801138 | 9/1988 | Germany . | |
| 3733996 | 4/1989 | Germany . | |
| 1536883 | 7/1991 | U.S.S.R. | 68/5 D |

*Primary Examiner*—Philip R. Coe
*Attorney, Agent, or Firm*—Kenyon & Kenyon

[57] ABSTRACT

The small finishing installation (100) for continuous strips of textile fabric includes a steam-filled housing (2) into which feed rolls (5) can be introduced at each end. Located in the housing are sets of fabric-handling equipment disposed symmetrically with respect to the vertical plane (40) running across the middle of the housing (2). Disposed in this vertical plane (40) is a squeezer unit (37) from which the strip of fabric can pass, against each feed roll (5), through a treatment bath (30) and then over an array (20) of guide rollers disposed above an open tank (26). The continuous strip of fabric (10) can be wound back and forth between the feed rolls (5), thus making it possible to carry out a variety of different treatments.

9 Claims, 1 Drawing Sheet

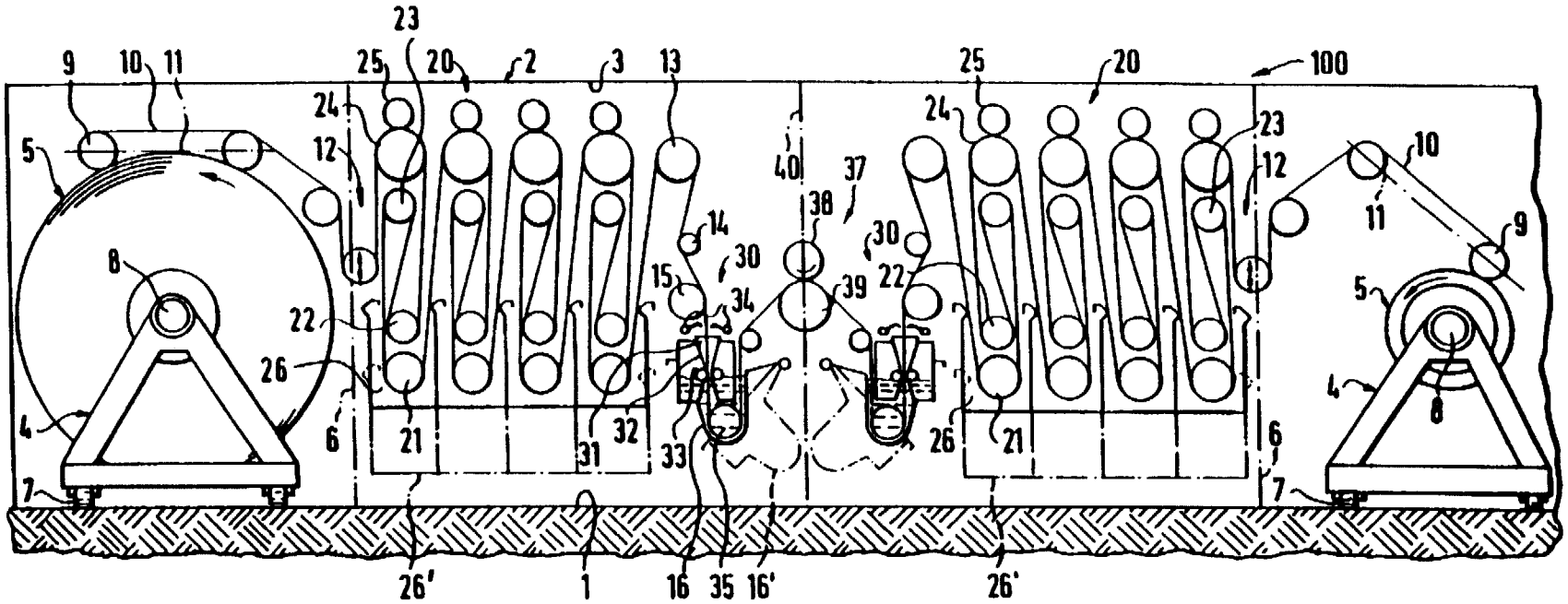
100
9
10
11
12
23
20
25
24
13
3
2
30
14
15
34
37
38
39
40
22
26
21
26'
16'
35
16
33
32
31
1
6
7
4
5
8

SMALL TEXTILE-FINISHING INSTALLATION

BACKGROUND OF THE INVENTION

The invention relates to a small textile-finishing installation for treating continuous strips of textile fabric.

Such a small textile-finishing installation is disclosed in DE 14 60 390 A 1. Here, the wet treatment device consists of a trough arranged in a fixed position between feed rolls, in which several guide rollers rotate in the treatment fluid. The textile strip is necessarily brought through the treatment fluid at each turn. At the exit in each instance, a squeezer unit is arranged, from which the textile strip reaches the take-up roll in each instance.

Present-day requirements for a textile-finishing operation are characterized by the short length of the individual yardages, which furthermore consist of changing materials and are supposed to be exposed to different treatments. There is a need to be able to handle these relatively short yardages in an adaptable manner, with the lowest possible expenditure and effort for apparatus, while still providing high quality with regard to uniformity and efficacy of treatment.

SUMMARY OF THE INVENTION

The present invention is directed towards the task of increasing the number and adaptability of the treatments which can be carried out with a textile-finishing installation of the foregoing general type.

The installation for treating continuous strips of textile fabric, comprising a steam-tight housing having an interior and closeable, steam-sealable openings on the housing leading into the interior of the housing. The housing has a vertical plane of symmetry dividing the housing into two equal halves. Feed rolls are located on feed carriages located at opposite ends in the interior of the housing, said carriages being transportable through the openings of the housing. The feed rolls are provided with drives to enable a textile strip to be wound and unwound from the feed rolls in a reciprocal manner.

The apparatus also includes at least one wet treatment device intermediate the feed rolls through which the textile strip passes. The wet treatment device comprises at least one squeezer unit located so that it is generally centered on the vertical plane of symmetry between the feed rolls. An application unit for simultaneous application of conservative amount of treatment fluid on both sides of the textile strip is arranged on each sides of the squeezer unit. An array of guide rollers having upper guide rollers which lie above lower guide rollers over which a textile strip is guided in vertical loops is provided. The bottom guide rollers can be dipped into the fluid tanks provided for this purpose, one array of such guide rollers being provided on each side of the center vertical plane outside of the application units. At least application units and the fluid tanks can optionally be put out of operation in such a way that the textile strip can pass through them without being acted on by the fluid.

The installation according to the invention is symmetrical with respect to its center, so that the same treatment can be carried out when winding the textile back and forth in a reciprocal manner. All the components of the installation, including the feed rolls, are located in a closed housing, in which a steam atmosphere and, therefore, a uniformly elevated temperature, can be maintained.

The squeezer unit in the center allows squeezing the strip after it passes through the application unit in question. The guide roller array allows it to stay in the steam atmosphere, i.e. allows steaming after the application of a dye fluid or a bleaching fluid.

However, the guide roller array can also function as a component of a washing device, if the bottom guide rollers are dipped into the fluid containers and therefore dipping treatment of the textile strip, with a subsequent reaction time, takes place there.

A textile-finishing installation with a housing with a steam atmosphere, a squeezer unit arranged in the center, and a guide roller array provided on both sides of the latter, is known from the reference MELLIAND TEXTILBERICHTE [MELLIAND TEXTILE REPORTS] 5(1977), pages 422 to 424, especially page 423, FIG. 4. This, however, involves a steamer alone, without application units and without fluid containers at the guide rollers.

It is noted that jiggers are a type of textile-finishing installations that are symmetrical with respect to their center, which also have the feed rolls in the housing and in which a squeezer unit is present between the feed rolls. In such devices, application devices are present on both sides of the squeezer unit, as is shown in DE 36 12 999 A1. However, jiggers are intended just as fluid treatment devices, without any possibility of keeping the open strip in them.

The application units are provided to guarantee uniform impregnation of the textile strip with a minimum of fluid content. Application units of the sort described in DE 14 60 265 and DE 37 33 996 (the contents of which are incorporated herein by reference for this purpose) may be employed. Such units have a narrow trough through which the textile strip vertically passes. The trough is formed by facing walls that form a V-shape, getting closer towards the bottom as they approach the textile. The narrow trough which is formed, through which the textile strip passes vertically, is filled with only about a hand's breadth of fluid, and is constantly refilled as it is used up by the textile strip, so that the textile strip always has fluid with a defined concentration applied to it, and no impoverishment phenomena occur. The content amounts to only about 8 L to 18 L in the case of a normal textile strip width of about 1.8 m, i.e. an amount which is sufficient for a short piece of the moving textile strip. The treatment fluid is present on both sides of the textile strip, and is massaged into the textile strip and stripped off it as it passes by the inflatable hose, two of which, lying opposite each other, are provided on both sides of the textile strip. If the pressure is removed from the hose or hoses, the textile strip can be passed through the application unit, especially from the top to the bottom, without the unit going into operation.

A guide roller, mounted in a fixed position below the trough, serves to guide the textile both into and out of the application unit. This is because the textile strip which is coming out of the application unit described from the bottom, must be guided upward, or, if it is coming from the top, it must be guided into the application unit from below. The fluid container, which can be pivoted away, serves to catch the small amounts of treatment fluid which unintentionally spill downwardly out of the application unit. It is also possible to carry out additional impregnation treatment in the container, with the guide roller, if such treatment is desired. By pivoting away the container, any treatment fluid present in it can remain there and the textile strip can pass by the guide roller without impregnation.

To ensure that the strip moves without problems, a width holder device located between the squeezer unit and the guide roller is recommended.

In one embodiment, the fluid tanks at the bottom guide rollers can be constructed made so they can be lowered, until the bottom guide rollers and the textile strip passing around them rise above the level of the treatment fluid present in the fluid tanks.

Furthermore, according to another aspect of the invention, squeezer rollers capable of being raised can be arranged on the top guide rollers, as is usual in washing machines.

To control the tension of the textile strip when it passes through the small textile finishing installation, and when winding up the feed rolls, a compensator may be provided between the guide roller arrays and the adjacent feed roll.

The individual units housed in the housing of the small textile-finishing installation can all be operated or put out of operation individually. However, the textile strip path remains the same all the time. For example, the textile strip can be unwound from a feed roll, whereupon it passes through the first guide roller array without fluid treatment. In the steam atmosphere which prevails in the housing, the textile strip is heated and pre-steamed over this distance, and reaches the first application unit in this condition, where a dye fluid can be applied, for example, which is squeezed off to a uniform textile strip moisture content in the squeezer unit in the middle, for which purpose it is recommended that this squeezer unit contain a deflection-controlled roller. The textile strip then passes through the application unit located on the other side of the squeezer unit, without the latter being in operation, and then runs into the second guide roller array, which forms a dwell segment for steaming the textile strip with the applied dye fluid. The textile strip is then wound up on the second feed roll.

When the textile strip is wound back, the steaming can be continued, in that both application units and the squeezer unit are put out of operation. After a sufficient steaming time, the fluid tanks on the bottom guide rollers are raised. They can contain a washing fluid through which the textile strip is passed. The guide roller arrays with the related squeezer rollers then act as washing units. It is also within the scope of the invention to subsequently use the small textile-finishing installation to dry the textile strip, in that the steam atmosphere in the housing is overheated.

BRIEF DESCRIPTION THE DRAWING

The drawing schematically shows an exemplary embodiment of the invention.

DETAILED DESCRIPTION OF THE INVENTION

The small textile-finishing installation, indicated as a whole with 100, comprises a housing 2 in the shape of a rectangular block, set up on the floor I of a building, which is equipped with means (not shown) to produce a steam atmosphere in its interior. It is especially structured in the region of its ceiling 3 so as to avoid dripping condensation water, as is known for steamers.

Near the ends, doors are provided in the housing, either in the face ends, or, as in the exemplary embodiment, in one of the side walls, which allow a feed roll carriage 4 with a feed roll 5 to be rolled in. In the exemplary embodiment, the doors are only indicated with their broken inside delimitation lines 6. The feed roll carriages 4 can be moved on the floor I of the building on casters 7, and have a driven winding axle 8, which can be coupled to a drive (not shown).

The textile strip 10 runs over a guide roller 9 which rests on the winder 5, onto the winder 5 which is rotating in the direction of the arrow, or from it. The roller 9 is mounted above the winder 5 on pivot arms 11, so that it can follow the changing winder diameter. In the operating phase shown in the drawing, the textile strip 10 is being wound off the left winder 5 and being wound onto the right winder 5, which still has a smaller diameter.

Coming from the left winder 5, the textile strip first passes over a compensator, designated as a whole with 12, which is used to control the lengthwise tension in the textile strip.

The textile strip 10 then reaches a guide roller array, designated as a whole with 20, which comprises four groups of four guide rollers 21, 22, 23, 24, which lie vertically one above the other, with the groups following each other in the lengthwise direction of the housing 2, over which the textile strip is guided in vertical double loops, as is known from washing machines. Squeezer rollers 25 sit on the top guide rollers 24.

The two bottom guide rollers 21, 22 of each group are arranged in a fluid tank 26, which can be lowered into the position shown with a broken line, together with the fluid in it, in which position the bottom guide roller 21 is above the level of the fluid. The fluid tanks 26 of the guide roller array 20 can be made so each can be lowered separately, but in general they are lowered together.

The upright double loops of the textile strip 10 in the guide roller array 20 represent a relatively large textile content and, as the textile strip 10 passes through at a constant velocity, a certain dwell time. From the last bottom guide roller in the transport direction, the textile strip 10 passes around a guide roller 13, arranged approximately at the level of the top guide rollers 24, and from there comes vertically from the top into an application unit 30 via a width holder roller 14 and an additional textile strip guide roller 15. The application unit 30 comprises a trough 31 which narrows from the top to the bottom, like a funnel, and extends horizontally over the width of the textile strip. It is formed by walls 32 which lie opposite one another on both sides of the textile strip 10, and which approach the textile strip towards the bottom of the trough 31. Towards the bottom, the trough is delimited by inflatable hoses 33 which stand opposite one another at the same level and rest against the textile strip 10 in the inflated state. When inflated, the hoses prevent the treatment fluid from flowing out downward out of the trough 31, and doctor the textile strip 10, which is charged with fluid as it passes vertically through the trough 31. This structure thereby helps impart a uniform moisture content over the width of the textile strip. The treatment fluid stands in the trough 31 only to a level of about 10 cm to 20 cm. The liquor content of the trough 31 is therefore slight, and is only sufficient for a short piece of the textile strip 10, at most a few meters. The liquor is constantly replaced via feed lines 34, as it is consumed by the textile strip 10. In other words, the textile strip 10 is constantly being impregnated with fresh liquor, on both sides, as it passes through the trough 31.

Below the exit gap formed by the two inflatable hoses 33, a guide roller 35 which rotates and is mounted in a fixed position is provided, by means of which the textile strip 10, coming vertically downward out of the exit gap, is guided upward, past the side of the application unit 30. After passing over a width holder roller 36, the strip 10 enters a squeezer unit 37. The squeezer unit 37 comprises rollers 38, 39 which lie above one another, with the top roller 38 in the exemplary embodiment being a deflection-controlled roller which allows a uniform squeezing effect over the width of the textile strip. The squeezer unit is arranged in a vertical center plane 40 of the housing 2.

Below the application unit 30, a fluid container 16 which holds the guide roller 35 is arranged, and catches the treatment fluid which might pass through at the exit gap between the inflatable hoses 33 and drip off the textile strip 10. The fluid container 16 can be pivoted downward into the position 16' shown with a broken line, at which position the guide roller 35 is above level of fluid in the fluid container 16. The fluid container 16 does not have to be emptied for this purpose.

All the units described until now, which are to the left of the center plane 40 according to the drawing, are present a second time, in a mirror image, on the right of this plane. The small textile-finishing installation 100 therefore has a symmetrical structure from the center plane 40 in the direction of the feed rolls 5. The textile strip 10 can therefore be subjected to the same treatment at it passes through the small textile-finishing plant, whether it is wound back or forth. However, it is also possible to make the treatment different in the different winding phases. For this purpose, the various units can be optionally put out of operation. For example, the fluid tanks 26 with the fluid contained in them can be lowered to the position 26', causing the textile strip to pass around the guide roller array in a dry state. Also, the squeezer rollers 25 can be lifted off the top guide rollers 24.

Likewise, one or both application units 30 can be put out of operation, in that no treatment fluid is added via the feed lines 34 any longer, and the inflatable hoses 23 are relieved of pressure. The textile strip 10 then passes through the passage gap formed between them, without being acted on. Also, the fluid container 16 can be pivoted downward into the position 16', so that the textile strip passes around the bottom guide roller 35 in the dry state.

Finally, the squeezer unit 37 can be opened.

All of these adjustments can be made in any combination desired, which makes it possible to set a large variety of possible treatment sequences. The textile strip 10 always passes through the small textile-finishing installation 100 in the same way, and does not have to be re-threaded each time. A treatment can also be repeated as often as desired, in order to reinforce the effect.

The low space requirement of the installation and the fact that the entire treatment takes place in one and the same steam atmosphere, so that temperature variations and heat losses are reduced to a minimum, are also important.

What is claimed is:

1. A small textile-finishing installation for treating continuous strips of textile fabric, comprising:

a steam-tight housing having an interior and closeable, steam-sealable openings on the housing leading into the interior of the housing, said housing having a vertical plane of symmetry dividing the housing into two equal halves;

feed rolls located on feed carriages located at opposite ends in the interior of the housing, said carriages being transportable through the openings of the housing into and out of the interior of the housing, said feed rolls having drives that enable a textile strip to be wound and unwound from the feed rolls in a reciprocal manner;

at least one wet treatment device intermediate the feed rolls through which the textile strip is intended to pass, said wet treatment device comprising at least one squeezer unit located so that it is generally centered on the vertical plane of symmetry between the feed rolls;

an application unit for simultaneous application of a reduced amount of treatment fluid on both sides of a textile strip arranged on each sides of the squeezer unit;

fluid tanks; and an array of guide rollers having upper guide rollers which lie above lower guide rollers over which a textile strip can be guided in vertical loops, such that the bottom guide rollers can be dipped into the fluid tanks provided for this purpose, one array of such guide rollers being provided on each side of the center vertical plane outside of the application units;

wherein at least the application units and the fluid tanks can optionally be put out of operation in such a way that the textile strip can pass through them without being acted on by fluid.

2. The small textile-finishing installation according to claim 1, the application units each comprising:

a narrow trough through which a textile strip can vertically pass, said trough being formed by walls arranged on both sides of the textile strip extending across the width of the textile strip, said walls approaching one another towards the bottom of the trough;

said trough being delimited towards the bottom, on at least one side of the textile strip, by an inflatable hose which runs crosswise and forms a seal against the textile strip, wherein treatment fluid can be passed to the trough via feed lines located above the hose.

3. The small textile-finishing installation according to claim 2, further comprising a guide roller mounted in a fixed position below the trough, such that a textile strip, whether exiting vertically downward from the trough or entering vertically upward into it, can be guided upward or downward via the guide roller outside the application unit.

4. The small textile-finishing installation according to claim 3, further comprising a width holder device located between the squeezer unit and the guide roller.

5. The small textile-finishing installation according to claim 2, wherein the fluid tank at the bottom guide rollers can be lowered, along with any treatment fluid they contain, until the bottom guide rollers lie completely above the fluid level.

6. The small textile-finishing installation according to claim 2, wherein a compensator to control the textile strip tension is arranged between the guide roller arrays and the adjacent feed roll in each instance.

7. The small textile-finishing installation according to claim 1, wherein the fluid tank at the bottom guide rollers can be lowered, along with any treatment fluid they contain, until the bottom guide rollers lie completely above the fluid level.

8. The small textile-finishing installation according to claim 1, further comprising squeezer rollers located on the upper guide rollers of the rolls forming vertical loops, said squeezer rollers being liftable away from the upper guide rollers.

9. The small textile-finishing, installation according to claim 1, wherein a compensator to control the textile strip tension is arranged between the guide roller arrays and the adjacent feed roll in each instance.

* * * * *